United States Patent [19]

Story

[11] Patent Number: 4,483,572

[45] Date of Patent: Nov. 20, 1984

[54] CONSOLE FOR VIDEO DISPLAY UNIT AND DETACHED KEYBOARD

[75] Inventor: Joe B. Story, Norcross, Ga.

[73] Assignee: Myrid Concepts Corporation, Atlanta, Ga.

[21] Appl. No.: 470,260

[22] Filed: Feb. 28, 1983

[51] Int. Cl.[3] ..... A47B 21/03

[52] U.S. Cl. ..... 312/196; 312/208; 312/322; 312/323

[58] Field of Search ..... 312/196, 322, 323, 21, 312/208; 108/93, 96, 105, 138, 143

[56] References Cited

U.S. PATENT DOCUMENTS 4,313,112 1/1982 Foster .
4,316,082 2/1982 Fritz ..... 312/313 X
4,379,429 4/1983 Gubbe ..... 108/143

FOREIGN PATENT DOCUMENTS 1168034 4/1964 Fed. Rep. of Germany ..... 312/323

*Primary Examiner*—William E. Lyddane
*Assistant Examiner*—Joseph Falk
*Attorney, Agent, or Firm*—Thomas & Kennedy

[57] ABSTRACT

A console or stand for a modular data processing system has a base with a top from which two sides depend and to which two races are pivoted. The console also has a platform to which two channels are rigidly mounted slidably supported upon the two races. So constructed, the platform may be moved between a raised, stored and sheltered position within the base and a lowered, operative position below and unsheltered by the base.

7 Claims, 6 Drawing Figures

CONSOLE FOR VIDEO DISPLAY UNIT AND DETACHED KEYBOARD

TECHNICAL FIELD

This invention relates to consoles or stands for use in supporting video display units and keyboards.

BACKGROUND OF THE INVENTION

Today, data processing systems typically have a video display unit in the form of a cathode ray tube, or CRT, and a keyboard located at a personnel work station. To provide set-up and system flexibility the keyboards are frequently detached from the display units with the two modules coupled together only by an electrical cord. Though such use of modules does provide benefits they nevertheless do present a problem where they are located together upon a common supporting surface as of a desk. This is because there is often insufficient depth to accommodate the keyboard and the display unit set one behind the other. As a result the display unit in such situations must be located to one side of the keyboard. This, however, requires that an operator maintain his or her head or eyes at a cocked angle from her torso to view the display unit while using the keyboard for otherwise the operator would have to sit facing the display unit itself and operate the keyboard in a skewed body position. Another problem presented by such positioning of the modules upon a common surface is that the normal typing height for a keyboard and the normal viewing height of a display unit are not the same.

The just described problem can be avoided by providing built-in type consoles. Representative of such build-in data processing consoles are those disclosed in U.S. Pat. Nos. 3,778,125 and 4,316,082. Though there is a market for such built-in consoles there remains a need to provide a console or stand for modular type data processing systems which may be supported on a typical secretarial type desk or other preexisting type of office furniture such as a credenza.

Applicant has heretofore provided one such console for use on an extension shelf component of an L-shape secretarial desk. As disclosed in U.S. patent application Ser. No. 203,812 of the present applicant this console includes a rigid base member adapted to be set upon the extension shelf of a secretarial desk, a movable floor upon which a keyboard may be supported and electrically coupled with the video display unit, and support means supporting the floor for movement between a keyboard operative position and a keyboard stored position. Though this console works very well when set upon an extension shelf or typewriter stand with the keyboard positioned thereon at normal typing height, such as 27 or 28 inches, it supports a keyboard at a height above normal typing height when the console is positioned on other support surfaces typically found in modern offices such as the principal but higher component of a secretarial desk or an office credenza. Other consoles have been designed for use upon such higher support surfaces like those disclosed in U.S. Pat. No. Des. 253,445 and U.S. Pat. No. 4,313,112. These, however, support a keyboard in a fixed position and do not possess the capability of relocating the keyboard for sheltered storage when not in use.

Accordingly, it is seen that a need remains to provide a console for a video display unit and detached keyboard which is adapted for use upon a supporting surface elevated substantially above normal typing height and which possesses the capability of relocating the keyboard between a higher, sheltered stored position and a lower, operative position. It thus is the provision of such a console to which the present invention is primarily directed.

SUMMARY OF THE INVENTION

In one form of the invention a console for a video display and detached keyboard, which is adapted for use upon a supporting surface elevated substantially above normal typing height, has a rigid base that includes a flat top from opposite ends of which two sides depend adapted to be set upon the supporting surface with a video display unit supported upon the top. The console also has a movable platform upon which a keyboard may be supported and electrically coupled with the video display unit and support means which movably supports the platform upon the base sides beneath the top for movement between a keyboard operative position with the platform projecting out from under the base member top at a height substantially below the bottom of the base sides and a keyboard stored position with the platform located beneath the base top between the two sides. The support means include a first elongated member pivotably mounted to one of the base sides and a second elongated member rigidly mounted to the platform and movably supported upon the first elongated member.

In another preferred form of the invention a console for a video display and detached keyboard, adapted to be set upon a stand elevated above normal typing height so as to position the keyboard at normal typing height, has a base with a top from which base top two sides depend. The console also has two elongated base guides pivotably mounted to the two base sides and a platform to which two elongated platform guides are rigidly mounted in sliding contact with the two base guides. So constructed, the platform may be moved between a stored, sheltered position within the base and an operative position below and unsheltered by the base.

DETAILED DESCRIPTION

Figure 1:
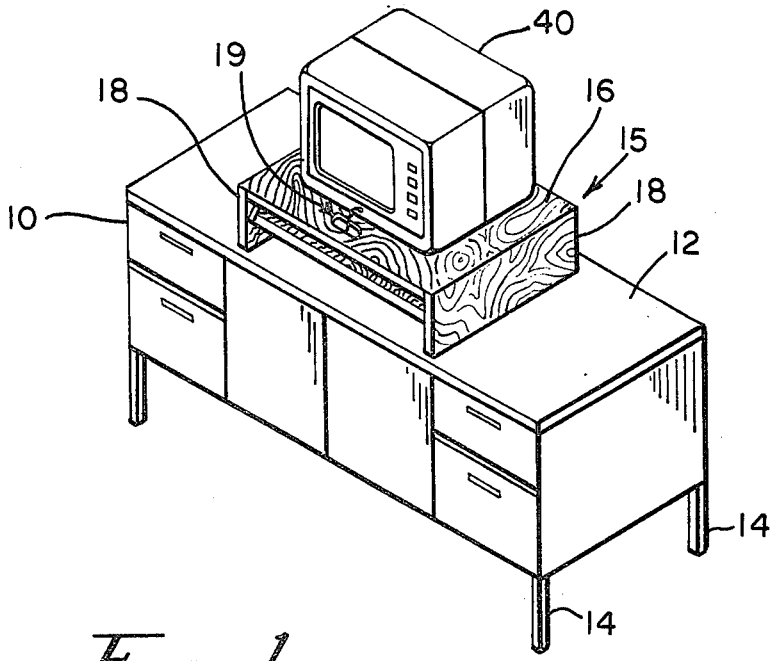
FIG. 1 is a perspective view of a console embodying principles of the invention shown set upon a credenza supporting a data processing system in a keyboard-stored position.

With reference next to the drawing, there is shown in the drawing a conventional office credenza 10 having a top 12 with an upper supporting surface located typically some 29 inches high above the bottom of credenza legs 14 and supporting floor. A console or stand 15 embodying principles of the present invention is shown supported upon the top 12 of the credenza 10. The console includes a rigid base 13 which has a flat top 16, upon which a video display unit may be supported, from opposite ends of which two sides 18 depend. The base also has a back 17 which extends from one side 18 to the other and a hole 19 formed in the top.

Figure 4:
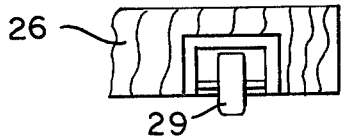
FIG. 4 is an end elevational view of a component of the console.

The console also includes a movable, keyboard supportable platform shown generally at 20 which has a flat platform floor 22 from opposite ends of which upright side members 24 upwardly extend. Each side member has a unitary extension portion 25 that juts above and beyond an end 26 of the floor 22 and a coextensive upright side 27. The extension portion 25 of each side member 24 has a lower edge 28 oriented parallel to the floor 22. Two wheels 29 are rotatably mounted to the platform floor adjacent the platform end 26, as best shown in FIG. 4.

The console also has support means for movably supporting the platform upon the base. The support means includes two elongated base guides in the form of two generally U-shaped races or channels 30 pivotably mounted by screws 32 to the two base sides 18. Two elongated platform guides in the form of two U-shaped slides or channels 31 are rigidly mounted to the platform side members 24 by screws 33. With the slides 31 telescopically or slidably received within the races 30 upon bearing runner assemblies 35 the platform may be moved between the elevated retracted, stored and sheltered position shown in FIG. 5 to the lowered extended and operative position shown in FIG. 6.

Figure 2:
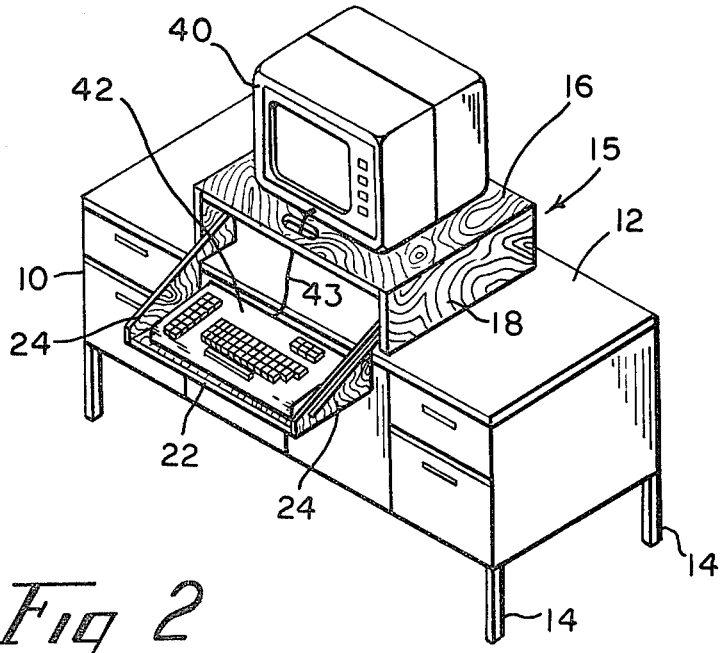
FIG. 2 is a perspective view of the console and supporting data processing system as illustrated in FIG. 2 shown in a keyboard-operative position.
Figure 3:
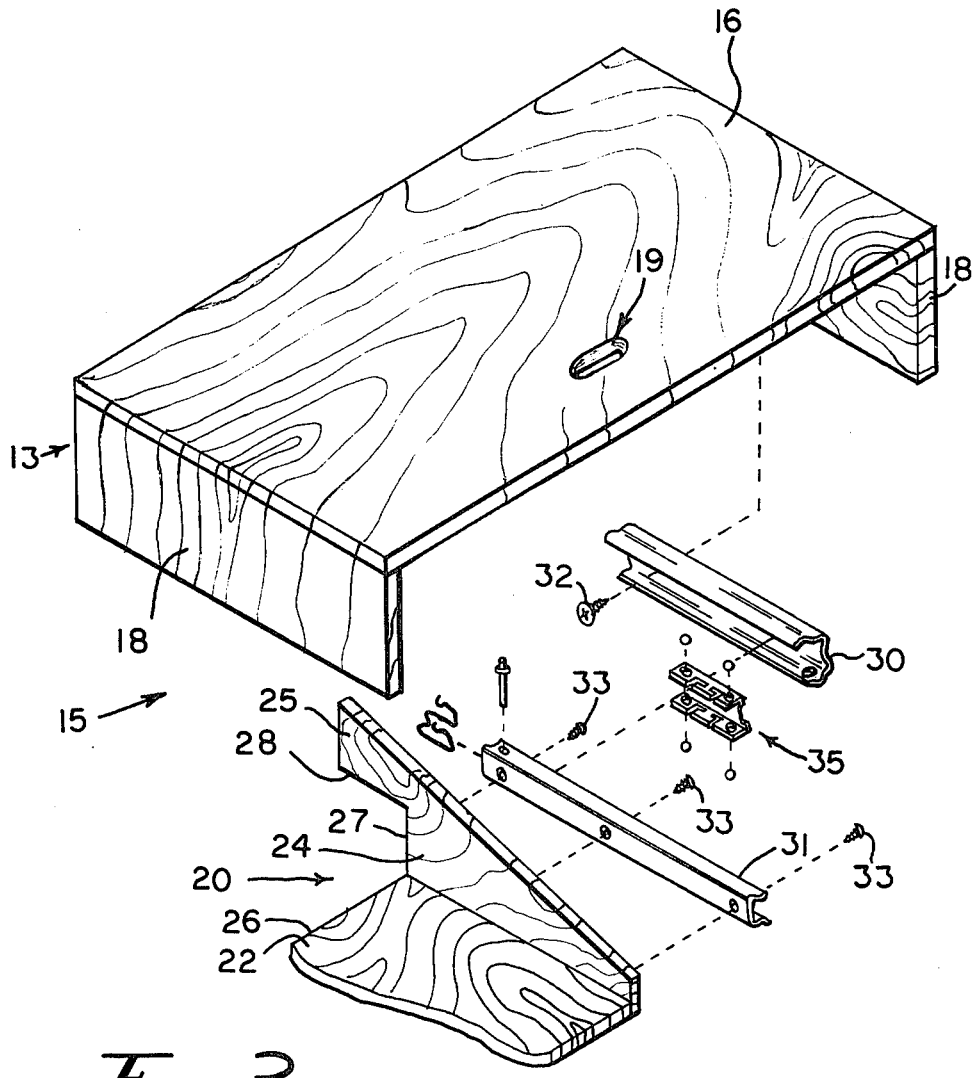
FIG. 3 is an exploded view of portions of the console shown in FIG. 1.
Figure 5:
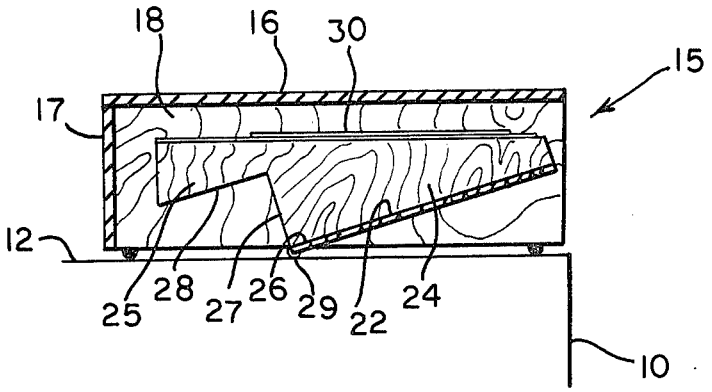
FIG. 5 is a side elevational view, in cross-section, of the console shown in a keyboard-stored position.
Figure 6:
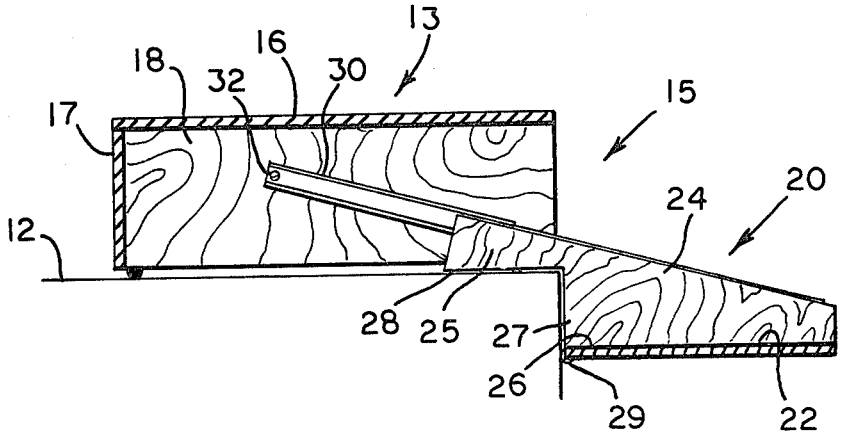
FIG. 6 is a side elevational view, in cross-section, of the console shown in a keyboard-operative position.

In operation the console 15 is set upon the top 12 of the credenza with a video display unit 40 supported upon the base top 16 and with a keyboard 42 set upon the platform floor 22. The keyboard is electrically coupled with the video display unit by means of an electrical cord 43 that extends from the keyboard through hole 17 to the display unit. The keyboard may be positioned in a stored, sheltered position beneath the top 16 of the base 15 as shown in FIGS. 1 and 5. In this position the platform is seen to be supported by wheels 29 upon the credenza top 12 oriented along an incline with respect to the credenza top. When it is desired to use the keyboard the platform is manually pulled out from under the top 16 of the base whereupon it rolls by wheels 29 upon the surface of the credenza top. Once the platform has exited the console base to an unsheltered position the platform is lowered to the position shown in FIGS. 2 and 6 whereupon the two races 30 pivot upon screws 32 that are threaded into the two base sides 18. The platform is lowered until the bottom edge 28 of the extension portion 25 of the upright side members 24 of the movable support for the keyboard come to rest upon the credenza top 12 as shown in FIG. 6. In this position the keyboard 42 supported upon the platform is located beneath the upper surface of the credenza top 12 at a normal typing height with space provided below the platform to accommodate the user's legs. In this position the platform is held in a very stable condition with the lower edge 28 resting upon the credenza and with upright edge 27 of the side members 24 preventing the platform and keyboard supported thereon from being urged by the keyboard user rearwardly back towards the base and credenza. Once it is desired to place the keyboard back into the stored position the platform is lifted and then rolled by rollers 29 upon the top 12 of the credenza back to the stored position shown in FIG. 5.

It should be understood that the just described embodiment merely illustrates principles of the invention in one preferred form. Many modifications, additions and deletions may, of course, be made thereto without departure from the scope of the invention as set forth in the following claims.

What is claimed is:

1. A console for a video display and detached keyboard adapted for use upon a supporting surface elevated substantially above normal typing height, and with said console comprising a rigid base that includes a generally flat top from opposite ends of which two sides depend adapted to be set upon the supporting surface with a video display unit supported upon said top; a movable platform upon which a keyboard may be supported and electrically coupled with the video display unit; and support means movably supporting said platform upon said two base sides beneath said top for movement between a keyboard operative position with said platform projecting generally parallel with and out from under said base member top at a height substantially below the bottom of said sides and a keyboard stored position with said platform located beneath said base member top between said two base sides; and with said support means including a first elongated member pivotably mounted at a pivot to one of said base sides for movement between a position generally parallel with said base member top in said keyboard stored position and a position sloping downward from said pivot in said keyboard operative position.

2. A console for a video display and detached keyboard in accordance with claim 1 wherein said support means second elongated member is rigidly mounted to one side of said platform, and wherein said support means includes a third elongated member pivotably mounted to the other of said base sides and a fourth elongated member rigidly mounted to the other side of said platform and movably supported upon said fourth elongated member.

3. A console for a video display and detached keyboard in accordance with claim 1 wherein said second elongated member is slidably supported upon said first elongated member.

4. A console for a video display and detached keyboard in accordance with claim 1 wherein said second elongated member is telescopically supported upon said first elongated member.

5. A console for a video display and detached keyboard in accordance with claim 1 wherein said platform includes a floor member from at least one side of which an upright side member upwardly extends.

6. A console for a video display and detached keyboard in accordance with claim 5 wherein said second elongated member is rigidly mounted to said platform upright member.

7. A console for a video display and detached keyboard in accordance with claim 5 wherein said upright member has an extension that juts above and beyond an end of said floor member, the bottom edge of said extension being oriented generally parallel with said floor member whereby with the platform supported by said support means in the keyboard operative position the extension bottom edge of the platform upright member may rest upon the supporting surface.

* * * * *